US005277343A

United States Patent [19]

Parsonage

[11] Patent Number: 5,277,343

[45] Date of Patent: Jan. 11, 1994

[54] CONTAINER WITH POURING SPOUT

[76] Inventor: Harvey J. Parsonage, "Mount Pleasant", Sofala, New South Wales 2795, Australia

[21] Appl. No.: 934,039

[22] Filed: Aug. 21, 1992

[30] Foreign Application Priority Data

Aug. 22, 1991 [AU] Australia ..... PK7919

[51] Int. Cl.[5] ..... B65D 25/42

[52] U.S. Cl. ..... 222/484; 222/538; 222/548; 222/498

[58] Field of Search ..... 222/465.1, 478–481, 482, 485, 530, 538, 532, 526, 548, 559

[56] References Cited

U.S. PATENT DOCUMENTS

| | | | |
|---|---|---|---|
| 720,854 | 2/1903 | Spiegler . | |
| 1,230,207 | 6/1917 | Norman . | |
| 1,617,992 | 2/1927 | Drake . | |
| 1,618,620 | 2/1927 | Wiswell . | |
| 1,729,839 | 10/1929 | Meggitt . | |
| 1,761,477 | 6/1930 | Kahle . | |
| 1,889,937 | 12/1932 | Spence . | |
| 1,994,442 | 3/1935 | Townsend . | |
| 2,022,343 | 11/1935 | Drood . | |
| 2,168,607 | 8/1939 | O'Brien . | |
| 2,168,608 | 8/1939 | O'Brien et al. . | |
| 2,168,609 | 8/1939 | O'Brien et al. . | |
| 2,375,221 | 5/1945 | Grice . | |
| 2,420,505 | 5/1947 | Stith . | |
| 2,455,769 | 12/1948 | Hermani . | |
| 2,516,728 | 7/1950 | Smith . | |
| 2,536,277 | 1/1951 | Grieme . | |
| 2,668,642 | 2/1954 | Johannesen . | |
| 2,782,967 | 2/1957 | Walker . | |
| 2,815,892 | 12/1957 | Richmond, Sr. . | |
| 2,816,695 | 12/1957 | Dagenais . | |
| 3,167,221 | 1/1965 | Feinstein et al. . | |
| 3,384,276 | 5/1968 | Henningfield | 222/484 X |
| 3,708,092 | 1/1973 | Frazer . | |
| 3,746,200 | 7/1973 | Flider . | |
| 3,782,610 | 1/1974 | Gilbert | 222/484 |
| 4,091,965 | 5/1978 | Gebhard | 222/548 X |
| 4,125,207 | 11/1978 | Ernst et al. . | |
| 4,456,007 | 6/1984 | Nakao et al. . | |
| 4,699,299 | 10/1987 | Gach | 222/482 X |
| 4,805,814 | 2/1989 | Allen, Sr. . | |
| 4,811,870 | 3/1989 | Bianco . | |
| 4,832,219 | 5/1989 | Nycz | 222/482 X |
| 4,887,746 | 12/1989 | Dubach . | |
| 5,058,778 | 10/1991 | Weinstein | 222/484 X |

FOREIGN PATENT DOCUMENTS

| | | |
|---|---|---|
| 147645 | 8/1952 | Australia . |
| 375521 | 5/1923 | Fed. Rep. of Germany . |
| 8143 | of 1897 | United Kingdom . |

*Primary Examiner*—Andres Kashnikow
*Assistant Examiner*—Kenneth DeRosa
*Attorney, Agent, or Firm*—Davis, Bujold & Streck

[57] ABSTRACT

The invention relates to a container incorporating a rotatable pouring spout that comprises a spout outlet remotely offset from a rotation axis and an inlet element rotatable about the axis . The container has an adjacent and corresponding outlet element. Each element has an opening offset from the rotation axis, which openings come into and out of register upon spout rotation. The container further incorporates a ball detent adapted to releasably engage the spout outlet when the openings are out of register. The spout can also be displaced along the rotation axis towards and away from the container between sealing and locking positions. The container may further comprise an engagement device which comprises a sealing element arranged between the inlet and outlet elements and extending around both openings when in register and around one of the openings when out of register. The engagement device also comprises a locking element arranged between the inlet and outlet elements that extends around one of the inlet or outlet elements when the spout is in the sealing position. When the spout is in the sealing position the sealing element engages both the inlet and outlet elements and the locking element engages only one of the inlet or outlet elements. When the spout is in the locking position, the sealing element and the locking element engage both the inlet and outlet elements.

20 Claims, 3 Drawing Sheets

CONTAINER WITH POURING SPOUT

BACKGROUND OF THE INVENTION

The present invention relates to a container incorporating a pouring spout. Whilst the invention has been developed primarily for use with fluids such as petroleum-based products, solvents and water, for their safe and easy storage and pouring, it should be appreciated that the invention can be equally well applied to other substances. The invention will be hereinafter described with reference to use with such fluids mentioned above.

Containers with incorporated spouts are well-known. For example fuel storage containers comprising elongate spouts recessed in the container outlet are known wherein a cap is removed from the container outlet and the spout is withdrawn prior to pouring. A problem experienced with this type of spout is that during pouring, the liquid in the container tends to seep or leak between the spout and the container outlet.

Containers are known which incorporate a spout which is rotated between an operative or pour position wherein, by suitable valve arrangements or otherwise the spout is placed in fluid communication with the container interior, and a non-operative or closed position wherein no fluid communication between the spout and container interior takes place. Many of the known arrangements have had complex and/or costly valve arrangements at the spout-container connection region and have not sealed this region to leakage particularly well. At the same time a rapid interchange between operative and non-operative positions has not been achieved.

A further problem experienced with many containers having an incorporated spout is that after pouring a fluid therefrom, the spout end can be contaminated by for example contact with the surrounding environment. Alternatively, the spout end can be damaged if the container is dropped or bumped etc. Some devices in the art have attempted to address this problem by mounting a stopper arrangement to the spout end however many of these arrangements have been complex, cumbersome and time consuming, especially where the arrangements have tended to fasten or stick to the spout end.

An aim of at least preferred form(s) of the present invention is to provide a container incorporating a pouring spout that can be easily and rapidly operated between open and closed positions and where the effects of leakage and/or seepage between the container and spout, and contamination between the spout and surrounds can be ameliorated or eliminated. Preferred forms of the present invention at the very least provide an alternative to existing prior art devices.

In a first aspect the present invention provides a container comprising a pouring spout, the spout being rotatable about a rotation axis between first and second positions, the spout comprising a spout outlet remotely offset from the rotation axis and an inlet element rotatable about the rotation axis, the container having an adjacent and corresponding outlet element, each element having an opening offset from the rotation axis, wherein the openings have no overlap when the spout is in the first position but are aligned when the spout is in the second position, the container further incorporating a ball detent for releasably engaging the spout outlet when the spout is in the first position.

Preferably the inlet element has a mating surface parallel to a corresponding mating surface on the outlet element, each mating surface having either the inlet element opening or the outlet element opening formed therethrough, wherein the rotation of the spout about the rotation axis from the first to the second position causes the opening in the inlet element mating surface to move from out of and into register with the opening in the outlet element. Preferably the inlet and outlet elements are disc-shaped and coaxial with the rotation axis. Preferably includes a ball, the ball detent is spring-loaded, and is arranged to at least partially sit in and retain the outlet of the spout in the first position.

With containers having incorporated spouts, it is sometimes advantageous or necessary to provide a tightened or increased form of sealing between the container and spout, preferably a gas-tight sealing, particularly when volatile liquids having a tendancy to increase container internal pressure are stored. At the same time, it is advantageous if the increased sealing is not so excessive that the spout fuses to or jams with the container, or requires excessive opening force.

In a second aspect the present invention provides a container comprising a pouring spout, the spout being rotatable about a rotation axis between first and second positions and displaceable along said axis towards and away from the container between sealing and locking positions, the spout comprising a spout outlet remotely offset from the rotation axis and an inlet element rotatable about the rotation axis, the container having an adjacent and corresponding outlet element, each element having an opening offset from the rotation axis, wherein the openings have no overlap when the spout is in the first position but are aligned when the spout is in the second position, the container further incorporating engagement means which comprises:

a sealing element arranged between the inlet and outlet elements, the sealing element extending around both openings when the spout is in the second position and one of the openings when the spout is in the first position; and a locking element arranged between the inlet and outlet elements and extending around one of the inlet or outlet elements when the spout is in the sealing position; wherein when the spout is in the sealing position the sealing element engages both the inlet and outlet elements and the locking element engages only said one of the inlet or outlet elements, and when the spout is in the locking position the sealing element and the locking element engage both the inlet and outlet elements.

Preferably the sealing and locking elements are ring shaped and preferably the sealing element is thicker than the locking element.

Preferably the inlet and outlet elements are disc-shaped and co-axial with the rotation axis and preferably the sealing element extends around and is adjacent to the periphery of one of the openings and the locking element extends around and adjacent the periphery of one of the discs.

Preferably both the sealing and locking elements are arranged on the outlet element. Preferably respective grooves are provided in the outlet element for receiving the sealing and locking elements.

Preferably, when the spout is in the sealing position the sealing element sits in its respective groove in the outlet element, and in the locking position both the sealing and locking elements sit in their respective groove in the outlet element.

Preferably, the sealing and locking elements are O-rings.

In a preferred form of both aspects of the invention the spout is detachable from the container and the container further includes locking means for releasably securing the spout to the container. The locking means can be a threaded locking ring coaxial with the rotation axis, which ring releasably engages a corresponding threaded section on the container and, when the ring is engaged, within which ring both the inlet and outlet elements are disposed.

Furthermore it is preferable that the locking ring is adapted to be rotated in a first direction to act on the inlet element of the spout and compel it towards the outlet element in a direction parallel to the rotation axis so that the inlet element is clamped against the outlet element in a pre-determined position thereby inhibiting spout rotation. In the second aspect of the invention this predetermined position can correspond with the sealing position, in which case the inlet element engages the sealing element. Accordingly further rotation of the locking ring in the first direction causes the inlet element to be moved so that the spout is displaced to the locking position wherein the inlet element engages the locking element.

This arrangement enhances fluid-tight (including gas-tight) sealing between the container and the spout. Furthermore, as the inlet element engages with the locking element a positive indication of the locking of the spout to the container is provided, whilst at the same time a sealing of the container-spout interface from the surrounding environment is achieved.

It is also preferred that the locking ring is adapted to be rotated in a second opposite direction to release the inlet element from the outlet element, or in the case of the second aspect of the invention, to release the inlet element from both the locking and sealing elements, thereby releasing the spout for rotation.

The locking ring can be adapted such that further rotation of the locking ring in the second direction releases completely both the ring and the spout from the container. This can be useful, where for example it is necessary to clean the spout and/or the container.

In a further preferred form the container includes a handle having a receptable which is arranged to receive the spout at the first position. The handle can also include the ball detent mounted therein for releasably engaging the outlet of the spout when the spout is positioned in the receptable in the first position.

Preferably the handle incorporates alignment means to facilitate alignment of the ball detent with the spout outlet in the first position. It is also preferable that the handle incorporates stop means which is arranged to enable spout alignment in the second position whereby the stop means engages the spout when it is rotated to the second position and prevents further spout rotation beyond the second position.

BRIEF DESCRIPTION OF THE DRAWINGS

A preferred embodiment of the invention will now be described, by way of example only, with reference to the accompanying drawings in which.

DETAILED DESCRIPTION OF THE INVENTION

Figure 1:
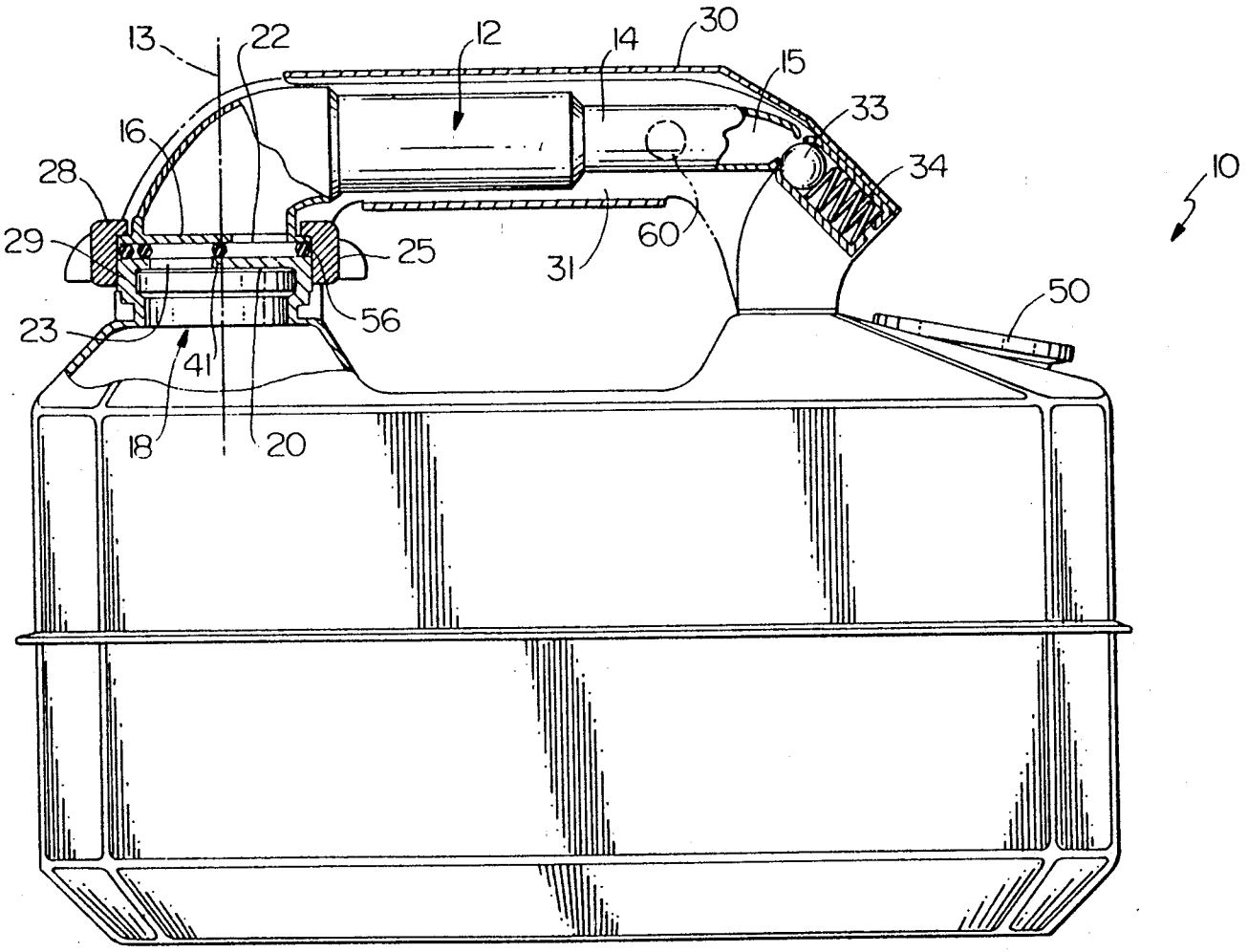
FIG. 1 shows a partially sectioned side view of a container incorporating a spout according to the present invention in which the spout is shown in a closed position.

Referring to the drawings, a container 10 incorporating a pouring spout in the form of a curved tube 12 is shown. The curved tube is rotatable about a rotation axis 13 and comprises a tapered nose 14 and an outlet 15 remotely offset from the axis 13.

Curved tube 12 is connected to an inlet element in the form of a circular plate 16 which is coaxial with the axis 13. The container is provided with a port 18 having an adjacent and corresponding outlet element in the form of a circular plate 20 which is also coaxial with axis 13. Circular plates 16 and 20 are provided with openings 22 and 23 respectively, each remotely offset from the axis 13.

Figure 3:
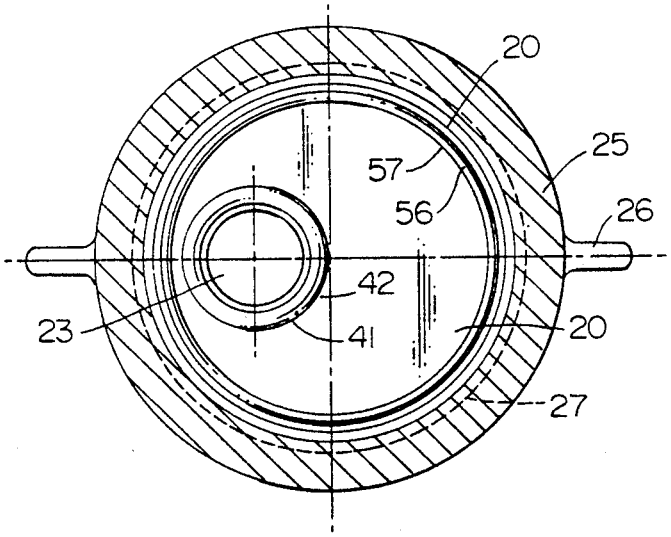
FIG. 3 shows a sectional view of the container-spout interconnector taken on the line 3-3 of FIG. 2.

The container includes locking means in the form of a threaded locking ring 25. The locking ring 25 has lugs 26 to aid in hand tightening and release of the locking ring. (See in particular FIG. 3, in which the locking ring is depicted as circular). The thread of the locking ring releasably engages a corresponding threaded section 27 at the container port 18. A circular lip 28 on the locking ring can engage, and functions to retain the circular plate 16 of the curved tube. Circular lip 28, locking ring 25 and circular plate 20 define a space 29 within which circular plate 16 can rotate at certain locking ring positions.

The container also includes a hollow handle 30 having a receptable 31 arranged to receive curved tube 12. When so received, outlet 15 of the curved tube is retained by a ball retainer 33 disposed in the hollow handle and spring-loaded by spring 34. Alternatively, the spring loaded ball retainer can be mounted appropriately elsewhere on the container, for example, to a projecting flange arrangement projecting from the container upper surface.

Circular plate 20 is provided with respective O-rings 41 and 56 on the upper face of the circular plate. O-rings 41 and 56 are retained on the circular plate 20 in respective grooves 42 and 57. (See in particular FIG. 3). O-ring 56 is thinner than O-ring 41 for reasons that will be explained hereafter. Both O-rings are typically fastened in the circular plate 20 to prevent ring dislodgement when, for example, the curved tube is dismantled from the container. Typically, both O-rings would be formed of a resilient material, including such polymeric materials as rubber, neoprene, teflon, etc.

O-ring 41 extends peripherally around the opening 23 provided in circular plate 20. O-ring 56 extends around the circular plate 20, adjacent its periphery. When the curved tube is in the position as shown in FIG. 1 (i.e. closed) O-ring 41 is located directly below the plate portion of circular plate 16 and engages therewith to facilitate sealing of container-spout interface.

The container is provided with a filler cap 50 for filling and transferral of fluids etc. to the container. The filler cap is usually provided with a form of venting arrangement (not shown) to aid pouring from the container. For example, small holes in the cap can be provided, or, when the filler cap is threadingly fitted, groove channels extending transversely to the thread can be provided for allowing the passage of air, (equalising container pressure with the atmosphere), during pouring. The filler cap can also be sized large enough to enable easy transfer of fluids etc when filling the container (e.g. from a petrol bowser or other container).

Figure 5:
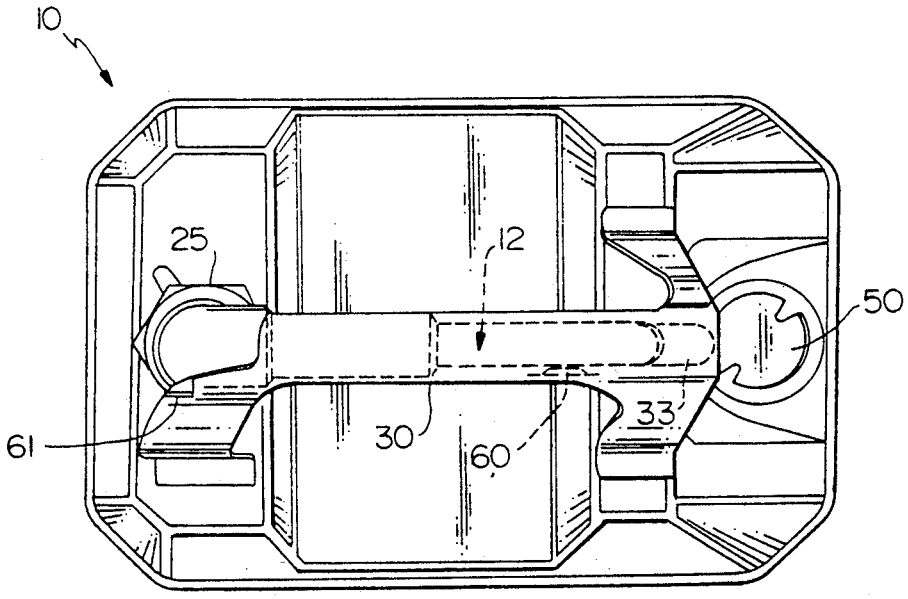
FIG. 5 shows a plan view of the container incorporating a spout according to the present invention with the spout in the closed position.

In order to enhance the rapid operational features of the container, a projecting lug 60 is provided in handle receptacle 31 which enables rapid alignment of the outlet 15 with the ball retainer 33. (This is best seen in FIG. 5). As the curved tube is rotated into its closed position, the outer surface of the tube nose 14 engages lug 60 thus preventing further rotational movement. The tube is releasably retained in the handle receptacle as the ball retainer partially sits in the outlet 15.

Figure 4:
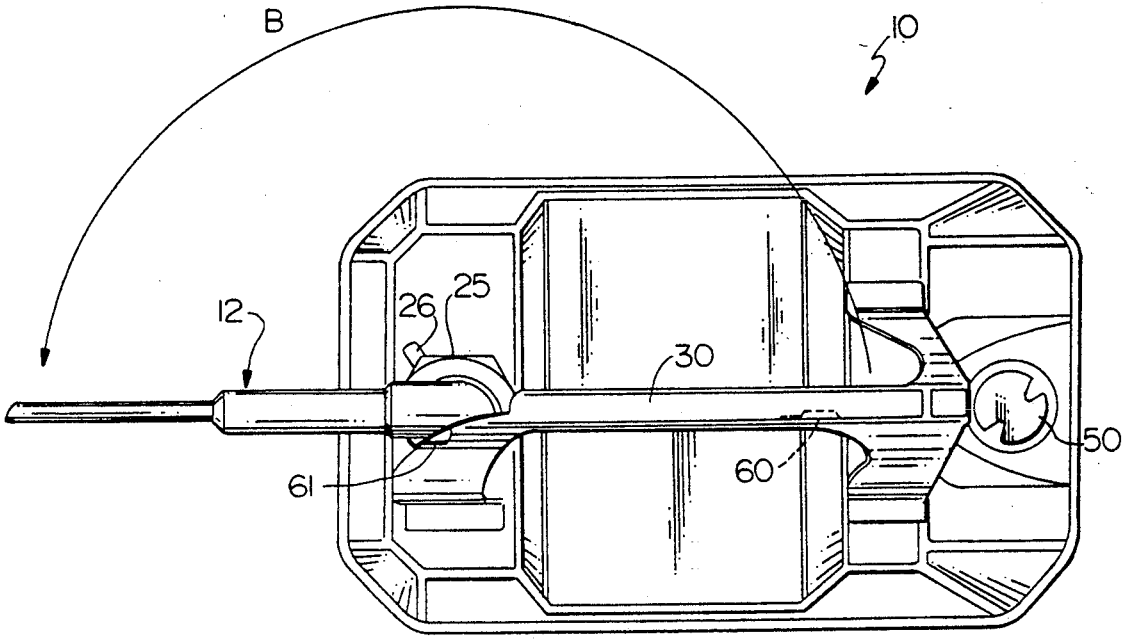
FIG. 4 shows a plan view of the container incorporating a spout according to the present invention with the spout in the open position.

For rapidly locating the curved tube 12 in the pouring or open position the container provides a bearing surface 61, arranged on the handle periphery. As seen in FIG. 4, the outer surface of the tube engages against bearing surface 61, preventing further rotation. The position of the tube in FIG. 4 corresponds with that of FIG. 2. In other words, the bearing surface enables rapid location of the container open position (i.e. in which openings 22 and 23 align).

One mode of use of the container will be described as follows:

The container is filled with fluid through the opening at filler cap 50 (i.e. the opening resulting from the removal of filler cap 50).

The container is set in the closed position (FIG. 1) to make it ready, for example, for transportation. To set the container in the closed position locking ring 25 is released to enable rotation of the curved tube about axis 13. The tube is then rotated until it is received in the receptacle 31 of the hollow handle 30. As the tube is urged into the receptacle, ball retainer 33 rides over the tube outlet 15, slightly compressing spring 34 until the ball partially sits in the outlet. At the same time nose 14 of the tube engages lug 60 preventing further rotation of the tube (see FIG. 5).

To seal the container locking ring 25 is then rotated so that it travels towards the container, wherein circular lip 28 engages and compels circular plate 16 causing it to impinge upon O-ring 41 and seal opening 23. Further rotation of the locking ring compresses O-ring 41, until circular plate 16 impinges upon O-ring 56. This second impingement can be detected by a user when tightening the locking ring, for example, by hand. Any further rotation increasingly tightens the seal and causes O-ring 56 to be compressed, firmly clamping both O-rings between the circular plates. Locking of the locking ring 25 is enhanced by this further rotation due to an increase in the reactive force of the O-rings to the compressive clamping imparted thereon by the circular plates; (i.e. this reactive force is transmitted via the circular plate 16 back to the circular lip 28 of the locking ring).

Advantageously, the engagement of circular plate 16 with O-ring 56 also functions to provide a user with an indication that tight sealing has been achieved. When so clamped, O-ring 56 functions to seal off the space between the circular plates from the surrounding environment and therefore minimises the lodgement of foreign matter therein. Also, as O-ring 41 is offset from the rotation axis, the presence of O-ring 56 facilitates parallel clamping between the circular plates, and therefore enhances even sealing and transmittal of clamping force from the circular plate 16 to O-ring 41. The container is now sealed, ready for transportation or storage.

When ready to pour the contents from the container locking ring 25 is released (i.e. rotated to travel away from the container). Circular plate 16 is therefore freed to rotate in space 29. The curved tube is withdrawn from the receptacle 31 gently urging outlet 15 to dislocate it from ball retainer 33 and the tube is then rotated (in the direction of arrow B of FIG. 4). The tube is rotated until the outer surface of the tube engages bearing surface 61 preventing further rotation. (This position is shown in FIG. 4 and corresponds with the position shown in FIG. 2 in which openings 22 and 23 align).

Figure 2:
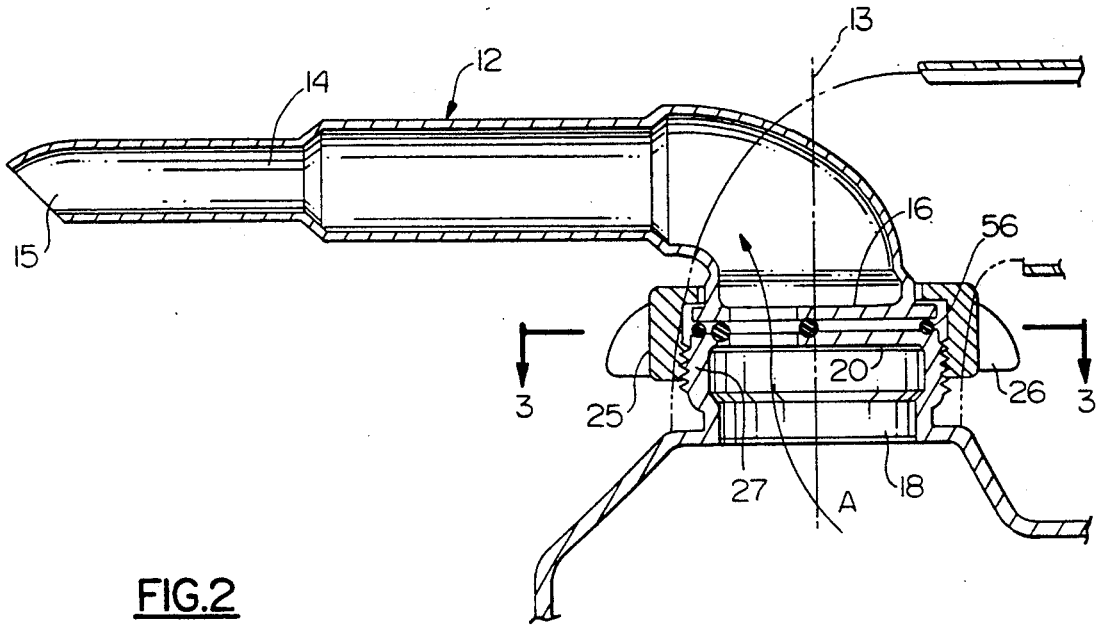
FIG. 2 details a cut-away sectional view of the spout and a portion of the container of FIG. 1 when the spout is in an open position.

The locking ring is once again tightened so that O-ring 41 is clamped between aligned openings 22 and 23 to define a sealed (fluid-tight) flow path (and is usually further tightened to also engage O-ring 56). The container is ready for pouring, and when fluid is poured from the container it travels in the direction of arrow A (FIG. 2). The above described process is reversed to close the container.

The preferred form described above is one form of a container incorporating a spout wherein rotation of the spout enables a rapid interchange between the container open and closed positions. Particularly effective sealing in the closed position can be achieved between the container and the spout due to the employment of the spout inlet/container outlet offset arrangement, coupled with a clamped O-ring seal. This preferred seal is also effective in preventing vapour leakage from the container. At the same time the provision of the outer ring element (in the preferred form as O-ring 56) facilitates tightening of the locking ring. The use of O-rings provides a durable, inexpensive and easily repaired or replaced form of sealing and locking.

A preferred spout shape includes a wide inlet and narrow outlet having a down-turned end, which enables positioning of the spout in a receptacle to which fluid is to be transferred, prior to pouring from the container.

The spring-loaded ball retainer of the preferred form prevents contamination of the spout end during transportation and storage of the container, when the spout is in the closed position. It enables the closed position to be rapidly located (particularly when employed together with the preferred handle lug 60) and assists in retaining the spout in the handle during spout transportation and storage.

The container handle when retaining the spout in the spout receptacle in the preferred form, provides an easily grasped handle for carrying the container. At the same time, the handle functions to shroud and protect the spout from damage and contamination during transportation and storage. This preferred construction also enables the handle to be centrally disposed on the container to facilitate level and balanced carrying of the container. At the same time this preferred construction provides a very robust and sturdy design with the spout and handle arrangement easily accommodating greatly varying weights of stored matter in the container.

The preferred form also produces a detachable spout. Thus the spout may be easily cleaned, repaired or replaced; (also with spouts or conduits of different shape). Removal of the spout enables easy access to the O-ring arrangement for cleaning, replacement and repair. Removal of the spout also enables an easier container cleaning (e.g. flushing via outlet 18 and the port opening at filler cap 50).

The preferred form of the container has the added advantage of optionally retaining the spout, which overcomes the need to use a separate spout that is often sullied, damaged or contaminated by the environment.

Typically all components of the container are fabricated from metal or plastic material with the O-rings (as mentioned above) being formed from a resilient polymeric material and the spring alternatively being formed from a resilient metallic material. Alternatively all of the components can be fabricated solely from metal to give the container increased strength and durability.

The container could be replaced with containers of various shapes as could the spout, whilst maintaining the circular plate and spout end retaining arrangement.

In this way, there can be provided a container incorporating a pouring spout that is rapidly interchanged between the open and closed positions, having a compact shape and which minimizes the problems of leakage and spillage, due to the effectiveness of the sealing arrangement provided in the container.

Whilst the invention has been described with reference to a particular embodiment, it will be appreciated that the invention can be embodied in many other forms.

What is claimed is:

1. A container comprising a pouring spout, the spout being rotatable about a rotation axis between first and second positions, the spout comprising a spout outlet remotely offset from the rotation axis and an inlet element rotatable about the rotation axis, the container having an adjacent and corresponding outlet element, each element having an opening offset from the rotation axis, wherein the openings have no overlap when the spout is in the first position but are aligned when the spout is in the second position, the container further incorporating a ball detent for releasably engaging the spout outlet when the spout is in the first position.

2. A container as claimed in claim 1 wherein the inlet element has a mating surface parallel to a corresponding mating surface on the outlet element, each mating surface having either the inlet element opening or the outlet element opening formed therethrough, wherein the rotation of the spout about the rotation axis from the first to the second position causes the opening in the inlet element mating surface to move from out of and into register with the opening in the outlet element.

3. A container as claimed in claim 1 wherein both the inlet and outlet elements are disc-shaped and coaxial with the rotation axis.

4. A container as claimed in claim 1 wherein the ball detent includes a ball, the ball is spring-loaded and is arranged to a least partially sit in and retain the outlet of the spout in the first position.

5. A container as claimed in claim 1 wherein the spout is detachable, the container further including a threaded locking ring for releasably securing the spout to the container, the locking ring being coaxial with the rotation axis, and releasably engaging a corresponding threaded section on the container such that, when the ring is engaged, both the inlet and outlet elements are disposed within the ring.

6. A container as claimed in claim 5 wherein the locking ring is adapted to be rotated in a first direction to act on the inlet element of the spout and compel it towards the outlet element in a direction parallel to the rotation axis so that the inlet element of the spout is clamped against the outlet element in a pre-determined position thereby inhibiting spout rotation, and wherein the locking ring is adapted to be rotated in a second opposite direction to release the inlet element from the outlet element thereby releasing the spout for rotation, and wherein further rotation of the locking ring in the second direction releases completely both the ring and the spout from the container.

7. A container as claimed in claim 1 further including a handle having a receptacle which is arranged to receive the spout at the first position, wherein the handle has the ball detent mounted therein for releasably engaging the outlet of the spout when the spout is positioned in the receptacle in the first position.

8. A container as claimed in claim 7 wherein the handle incorporates alignment means to facilitate alignment of the ball detent with the outlet at the first position, and incorporates stop means which is arranged to engage the spout when it is rotated to the second position to enable spout alignment in the second position and prevent further spout rotation beyond the second position.

9. A container as claimed in claim 8 wherein the alignment means is a lug projecting from a surface of the receptacle inside the handle, the lug being adapted to engage an outer surface of the spout when the spout is rotated in to the first position thereby preventing further rotation.

10. A container as claimed in claim 8, wherein the stop means is a preformed surface on the handle which is adapted to engage an outer surface of the spout.

11. A container comprising a pouring spout, the spout being rotatable about a rotation axis between first and second positions and displaceable along said axis towards and away from the container between sealing and locking positions, the spout comprising a spout outlet remotely offset from the rotation axis and a disc-shaped inlet element coaxial with the rotation axis, the container having an adjacent and corresponding disc-shaped outlet element coaxial with the rotation axis, each disc-shaped element having an opening offset from the rotation axis, wherein the openings have no overlap when the spout is in the first position but are aligned when the spout is in the second position, the container further incorporating engagement means which comprises:

a sealing element arranged between the inlet and outlet elements, the sealing element extending around both openings when the spout is in the second position and one of the openings when the spout is in the first position; and a locking element arranged between the inlet and outlet elements and extending around one of the inlet or outlet elements when the spout is in the sealing position;

wherein when the spout is in the sealing position the sealing element engages both the inlet and outlet elements and the locking element engages only said one of the inlet or outlet elements, and when the spout is in the locking position the sealing element and the locking element engage both the inlet and outlet elements.

12. A container as claimed in claim 11 wherein the sealing and locking elements are ring shaped and the sealing element is thicker than the locking element.

13. A container as claimed in claim 11 wherein the inlet and outlet elements are disc-shaped and coaxial with the rotation axis.

14. A container as claimed in claim 23 wherein the sealing element extends around and is adjacent to the periphery of one of the openings and the locking element extends around and is adjacent to the periphery of one of the discs.

15. A container as claimed in claim 11 wherein both the sealing and locking elements are arranged on the outlet element.

16. A container as claimed in claim 15 wherein respective grooves are provided in the outlet element for receiving the sealing and locking elements.

17. A container as claimed in claim 16, wherein in the sealing position the sealing element sits in its respective groove in the outlet element, and in the locking position both the sealing and locking elements sit in their respective groove in the outlet element.

18. A container as claimed in claim 11 wherein the sealing and locking elements are O-rings.

19. A container as claimed in claim 11 wherein the spout is detachable, the container further including a threaded locking ring for releasably securing the spout to the container, the locking ring being coaxial with the rotation axis, and releasably engaging a corresponding threaded section on the container such that, when the ring is engaged, both the inlet and outlet elements are disposed within the ring.

20. A container as claimed in claim 19 wherein the locking ring is adapted to be rotated in a first direction to act on the inlet element of the spout and compel it towards the outlet element in a direction parallel to the rotation axis so that the inlet element engages the sealing element at the sealing position, and wherein further rotation of the locking ring in the first direction causes the inlet element to be compelled closer to the outlet element so that the inlet element also engages the locking element at the locking position.

* * * * *